US006854389B2

(12) United States Patent
Endisch et al.

(10) Patent No.: US 6,854,389 B2
(45) Date of Patent: Feb. 15, 2005

(54) BLANKET CYLINDER FOR OFFSET PRESSES

(75) Inventors: Martin Endisch, Wertingen (DE); Peter Knauer, Münster/Lech (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/734,796

(22) Filed: Dec. 11, 2003

(65) Prior Publication Data

US 2004/0123755 A1 Jul. 1, 2004

(30) Foreign Application Priority Data

Dec. 11, 2002 (DE) ..... 102 58 048

(51) Int. Cl.[7] ..... B41F 7/02

(52) U.S. Cl. ..... 101/217; 101/376; 101/395; 101/401.1

(58) Field of Search ..... 101/217, 376, 101/395, 401.1

(56) References Cited

U.S. PATENT DOCUMENTS

| | | | | |
|---|---|---|---|---|
| 6,105,498 A | | 8/2000 | Vrotacoe et al. | |
| 6,349,646 B1 | | 2/2002 | Hasegawa et al. | |
| 6,513,425 B1 | * | 2/2003 | Brox | 100/329 |
| 6,651,559 B2 | * | 11/2003 | Haraux et al. | 101/376 |
| 2004/0139871 A1 | * | 7/2004 | Knauer et al. | 101/216 |

FOREIGN PATENT DOCUMENTS

| | | |
|---|---|---|
| DE | 27 01 670 | 7/1978 |
| DE | 34 10 638 | 7/1988 |
| DE | 44 36 973 | 6/1995 |
| DE | 296 12 105 | 10/1996 |
| EP | 10 82 601 | 6/1960 |
| EP | 0 704 301 | 5/1995 |
| JP | 06246896 | 9/1994 |

* cited by examiner

*Primary Examiner*—Andrew H. Hirshfeld
*Assistant Examiner*—Marissa Ferguson
(74) *Attorney, Agent, or Firm*—Cohen, Pontani, Lieberman & Pavane

(57) ABSTRACT

A blanket cylinder has a rotational axis and a concave surface, concentric to the axis and extending over a printing width of the cylinder, for receiving a flat rubber blanket made of elastically deformable material. The cylinder has a recess concentric to the axis, extending over the printing width, and a film fitted in the recess The film has an outside surface which forms the concave surface of the blanket cylinder.

4 Claims, 1 Drawing Sheet

BLANKET CYLINDER FOR OFFSET PRESSES

BACKGROUND OF THE INVENTION

1. Field of the Invention

The invention relates to a blanket cylinder of the type having a rotational axis and a concave surface, concentric to the axis and extending over a printing width of the cylinder, for receiving a flat rubber blanket made of elastically deformable material.

2. Description of the Related Art

In rotary offset presses, the printing image is, as is known, transferred from the plate or forme cylinder onto the blanket cylinder, and from the latter onto the paper running over the impression cylinder. It is only possible to transfer the ink, both from the printing forme onto the rubber sleeve and from the rubber sleeve onto the paper, if a certain minimum pressure is present, what is known as the line pressure between the blanket cylinder and plate or forme cylinder.

Here, a problem arises for quality assurance from the demand for ever higher productivity, and as a result of the efforts to produce printing cylinders which are as light and cost-effective as possible. Especially what is referred to as channel-less printing, in particular therefore the sleeve technique, which is distinguished by a printing forme applied without a channel onto a sleeve and/or a rubber blanket applied without a channel, allows the rigidity to be reduced because of the lessened oscillation excitation as a result of the missing cylinder channels. As a result, the length-to-thickness ratio of the printing cylinders, or their relative rigidity with regard to deflection, becomes ever more unfavorable. The consequence of this is that, during printing operation, the shape and position of the printing cylinders with respect to one another change in an undesired manner, i.e. the printing cylinders are deflected.

The positional change as a consequence of a deflection changes the printing pressure, i.e. the setting pressure between the printing cylinders interacting in the printing unit, this setting pressure becoming non-uniform as seen across the cylinder width. This printing pressure is usually determined in numerical values by measuring what is referred to as the imprint width, i.e. the width of the zone which defines the contact area of the cylinders when the cylinders are thrown onto one another, i.e. moved to the pressure position. This measurement is particularly simple in offset printing, since here one cylinder of a pair of cylinders always has a compressible (soft) surface.

As a result of the mechanical misalignment remaining with this, folds can form, as is known, in the conveyed paper web in the press nip of the rubber cylinder if the paper web is moving here with an irregular speed profile across the width because of the above-described positional change, the center of the paper web moving more quickly than the outside of the web, which leads to the formation of folds and hence to printing register problems. In order to counteract printing register problems of this type, various methods are used nowadays. For example, image regulators which influence the web width are used. The image regulators are, as is known, rotating small wheels which press width-reducing furrows into the web. A further method for eliminating this problem is described in DE 44 36 973 A1: the surface geometry of rubber blankets (rubber sleeves here) is configured concavely or convexly across the web width, i.e. a thickness profile varied by the circumferential surface assuming a convex or concave shape on the blanket cylinder in the axial direction of the cylinder. That is to say, concavely ground rubber blankets/rubber sleeves and concavely ground cylinder surfaces, in particular, are described in conjunction with flat rubber blankets/rubber sleeves.

Furthermore, attempts have also already been made to eliminate the above-described printing register problems by means of an appropriately placed support in the form of an inserted film between the blanket cylinder and the rubber blanket. For example, EP 0 704 301 B1 describes a thin intermediate layer for adjusting and improved anchoring of a rubber blanket on a blanket cylinder, in the form of a self-adhesive plastic film. For this purpose, the surface of the blanket cylinder has a region, which is recessed to correspond with the thickness of the thin film, in the form of a diameter reduction.

SUMMARY OF THE INVENTION

It is an object of the present invention to develop a blanket cylinder in such a way that quality assurance, in which it is possible to influence the conveying characteristics of a rubber blanket, in rotary printing is possible without having to grind the surface of the rubber blanket convexly or concavely or having to perform other measures on the rubber blanket and in order to keep the measures on the blanket cylinder simple and cost-effective.

According to the invention, the cylinder has a recess concentric to the axis, extending over the printing form width, and a film fitted in the recess. The film has an outside surface which forms the concave surface of the blanket cylinder.

It is possible to apply this measure to rubber sleeves both with and without a gap.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENT

Figures 1, 2, 3:
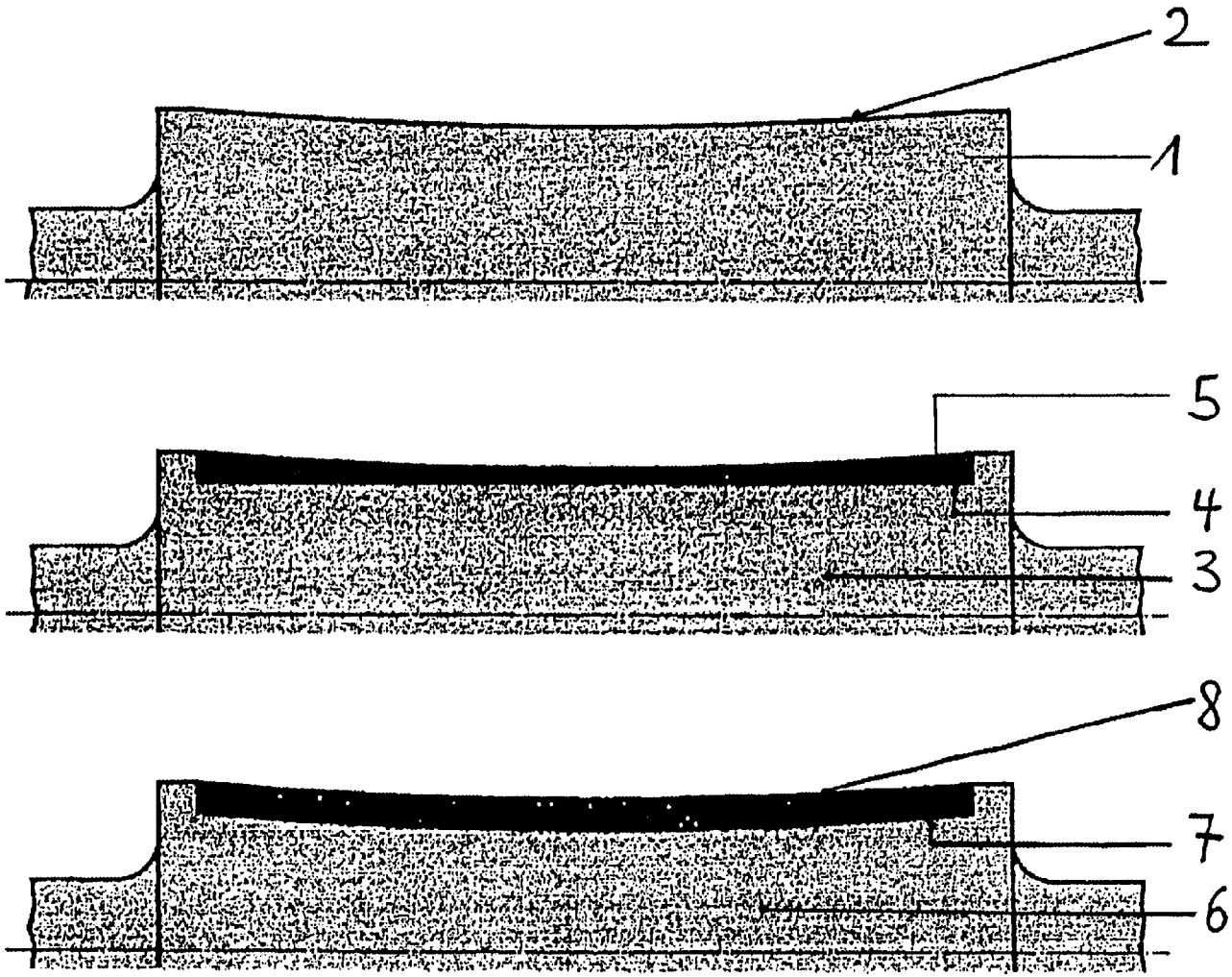
Fig. 1 (PRIOR ART)
FIG. 1 shows a blanket cylinder with a concavely ground cylinder surface according to the prior art.
FIG. 2 shows a first embodiment of a blanket cylinder configured according to the invention with a surface region, which is recessed to correspond with the thickness of a thin film support, in the form of a diameter reduction and a concavely manufactured film laid on it.
FIG. 3 shows a second embodiment of a blanket cylinder according to the invention with a concavely ground recessed surface region and inserted film.

FIG. 1 shows a blanket cylinder 1 according to DE 44 36 973, with a concavely ground cylinder surface 2, for which purpose it is possible to use a flat rubber blanket, which can be given a concave surface profile of this type, so that the lateral ends of the surface of the rubber blanket are radially further removed from the rotational axis of the blanket cylinder 1 located underneath than the center of the rubber blanket. The surface speed profile resulting from this improves the conveying behavior with regard to a paper web and avoids the formation of folds. The process of grinding the blanket cylinder is, nevertheless, complicated.

FIG. 2 shows a blanket cylinder 3 according to the invention with a recessed surface region 4 running parallel to the rotational axis in the form of a constant diameter reduction. A film 5 is inserted into this surface region 4, which film 5 is concavely manufactured on at least the outer side, completely fills the surface region 4 and indirectly imparts to the circumferential surface of the blanket cylinder 3 a concave shape extending symmetrically with respect to the center.

The concavely manufactured film 5 can be a self-adhesive plastic film which is easy to exchange. The film 5 can, of course, also itself be configured as an exchangeable sleeve. The film 5 assists in, firstly, adjusting the rubber blanket (with a channel or as a sleeve) on the cylinder and, secondly, offering optimum adhesion on the cylinder core.

FIG. 3 shows a blanket cylinder 6 according to FIG. 2 which, however, has a recessed surface region 7 which is concavely ground symmetrically with respect to the center. It is possible to insert a flat or likewise concave film 8 into this surface region 7.

The invention is not limited by the embodiments described above which are presented as examples only but can be modified in various ways within the scope of protection defined by the appended patent claims.

We claim:

1. A blanket cylinder for a printing press, said blanket cylinder having a rotational axis and a concave surface, concentric to said axis and extending over a printing width of said cylinder, for receiving a flat rubber blanket made of elastically deformable material, said cylinder comprising:

a recess concentric to said axis and extending over said printing width; and a film fitted in said recess, said film having an outside surface which forms said concave surface of said blanket cylinder.

2. A blanket cylinder as in claim 1 wherein said recess has a concave surface, said film having a uniform thickness.

3. A blanket cylinder as in claim 1 wherein said film fills said recess.

4. A blanket cylinder as in claim 1 wherein said recess has a cylindrical surface, said film being received against said cylindrical surface.

* * * * *